US010086434B2

(12) United States Patent
Liu et al.

(10) Patent No.: US 10,086,434 B2
(45) Date of Patent: Oct. 2, 2018

(54) METHOD OF PREPARING SHAPE-CONTROLLED PLATINUM BASED ALLOYS

(71) Applicant: NISSAN NORTH AMERICA, INC., Franklin, TN (US)

(72) Inventors: Ying Liu, Walled Lake, MI (US); Nilesh Dale, Novi, MI (US)

(73) Assignee: Nissan North America, Inc., Franklin, TN (US)

( * ) Notice: Subject to any disclaimer, the term of this patent is extended or adjusted under 35 U.S.C. 154(b) by 286 days.

(21) Appl. No.: 15/084,731

(22) Filed: Mar. 30, 2016

(65) Prior Publication Data

US 2017/0282253 A1 Oct. 5, 2017

(51) Int. Cl.

| | |
|---|---|
| ***B22F 9/30*** | (2006.01) |
| ***B22F 9/24*** | (2006.01) |
| ***B22F 1/00*** | (2006.01) |

(52) U.S. Cl.

CPC ..... *B22F 9/30* (2013.01); *B22F 1/0007* (2013.01); *B22F 9/24* (2013.01); *B22F 2009/245* (2013.01); *B22F 2202/11* (2013.01); *B22F 2301/15* (2013.01); *B22F 2301/25* (2013.01); *B22F 2998/10* (2013.01)

(58) Field of Classification Search

CPC ..... B22F 9/30; B22F 9/24; B22F 1/007

See application file for complete search history.

(56) References Cited

U.S. PATENT DOCUMENTS

2017/0282253 A1* 10/2017 Liu ..... B22F 9/30

FOREIGN PATENT DOCUMENTS

| | | | |
|---|---|---|---|
| CN | 102327771 A | | 1/2012 |
| CN | 102941085 A | * | 2/2013 |
| CN | 103817344 A | | 5/2014 |
| CN | 104393312 A | | 3/2015 |

OTHER PUBLICATIONS

Partial English language translation of CN102941086A, Feb. 27, 2013.*

Nassr, et al., "Rapid Microwave-Assisted Polyol Reduction for the Preparation of Highly Active PtNi/CNT Electrocatalysts for Methanol Oxidation", ACS Catalysis 2014, 4(8), 2449-2462.

* cited by examiner

*Primary Examiner* — Scott R Kastler

(74) *Attorney, Agent, or Firm* — Young Basile Hanlon & MacFarlane, P.C.

(57) ABSTRACT

A method of preparing shape-controlled alloy particles includes dissolving a solvent in a surfactant selected to inhibit particle growth; adding a noble metal precursor and a transition metal precursor to form a mixture; irradiating the mixture with a microwave under reflux for about thirty minutes or less at an irradiation temperature of between 185° C. and 195° C.; cooling the mixture; and drying the mixture at a temperature of between 55° C. and 65° C. to obtain shape-controlled alloy particles having a uniform shape, the shape dependent upon the surfactant used.

13 Claims, 2 Drawing Sheets

METHOD OF PREPARING SHAPE-CONTROLLED PLATINUM BASED ALLOYS

TECHNICAL FIELD

This disclosure relates to method of preparing shape-controlled alloy particles having a noble metal and a transition metal, and in particular, using microwave irradiation with a shape-controlling agent to prepare the shape-controlled alloy particles.

BACKGROUND

Alloying platinum with a secondary metal reduces the usage of platinum metal while at the same time improving platinum performance for some catalyst applications, such as fuel cells. The shape of the platinum alloys can have a significant influence on the performance of the catalyst. It is difficult to prepare platinum alloys have a consistent and uniform shape using conventional methods.

SUMMARY

Disclosed herein are methods of preparing shape-controlled alloy particles. One method disclosed herein includes dissolving a solvent in a surfactant selected to inhibit particle growth; adding a noble metal precursor and a transition metal precursor to form a mixture; irradiating the mixture with a microwave under reflux for about thirty minutes or less at an irradiation temperature of between 185° C. and 195° C.; cooling the mixture; and drying the mixture at a temperature of between 55° C. and 65° C. to obtain shape-controlled alloy particles having a uniform shape, the shape dependent upon the surfactant used.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Microwave irradiation is an efficient heating method used for chemical reactions. However, using microwave irradiation to prepare platinum alloys has not been successful due to the random shapes of the particles produced. Because the shape of the platinum alloy particles has an effect on performance, and uniformity in shape provides increased performance, a method of producing noble metal alloy particles having a desired and consistent shape using microwave irradiation is desired.

The methods disclosed herein provide the noble metal alloy particles having a desired and consistent shape using microwave irradiation. The inventors have discovered a route for the preparation of shape-controlled colloidal noble metal nanoparticles in a single-step process, involving the direct heat-treatment of an organic solution containing a shape-controlling agent. The shape-controlling agent is a surfactant selected to inhibit particle growth, which controls the shape of the alloy particles, resulting in uniform shape. Different shape-controlling agents can be selected to produce different shapes, with the method producing the selected shape uniformly throughout the resulting particles.

Figure 1:
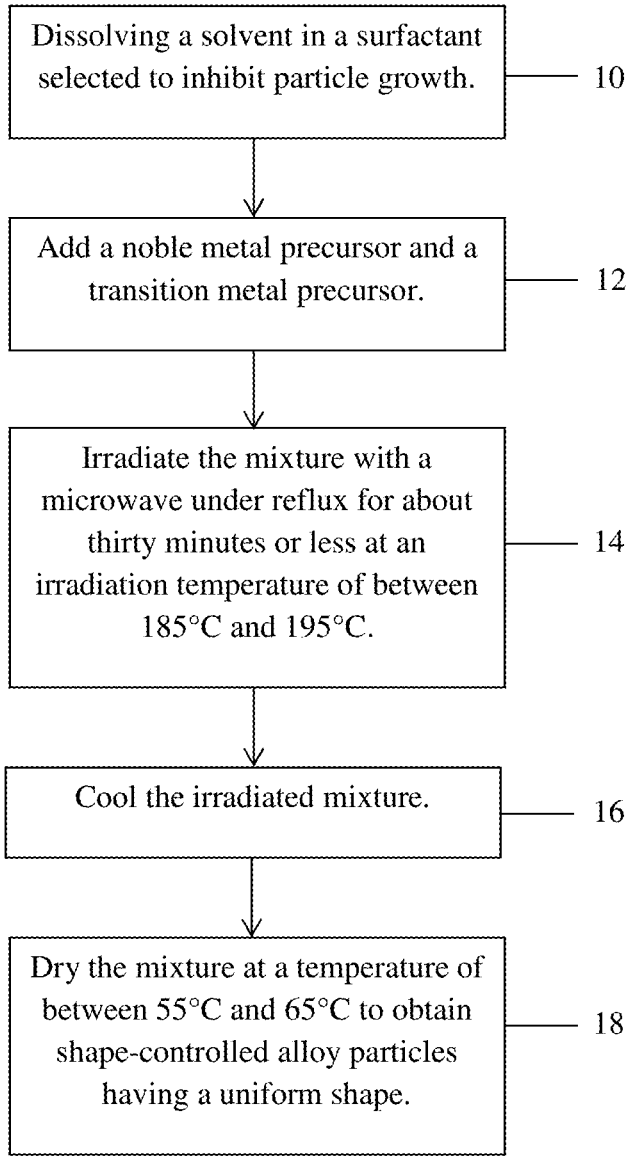
FIG. 1 is a flow diagram of the method disclosed herein.

A method of preparing shape-controlled alloy particles is shown in FIG. 1 and includes dissolving a solvent in a surfactant selected to inhibit particle growth in step 10. A noble metal precursor and a transition metal precursor are added in step 12 to form a mixture. Irradiate the mixture with a microwave under reflux for about thirty minutes or less at an irradiation temperature of between 185° C. and 195° C. in step 14. Cool the mixture in step 16 and dry the mixture at a temperature of between 55° C. and 65° C. in step 18 to obtain shape-controlled alloy particles having a uniform shape, the shape dependent upon the surfactant used.

In one example of the method, the surfactant is benzoic acid, the solvent is benzyl alcohol, the noble metal precursor is platinum(II) acetylacetonate and the transition metal precursor is nickel(II) acetylacetonate. The resulting platinum alloy has a uniform, octahedral shape.

In another example of the method, the solvent is 1,2-hexadecanediol, the surfactant is oleylamine, the noble metal precursor is platinum(II) acetylacetonate and the transition metal precursor is cobalt(II) acetylacetonate or dicobalt octacarbonyl. The resulting platinum alloy has a uniform, octahedral shape.

In another example of the method, the surfactant is aniline, the solvent is benzyl alcohol, the noble metal precursor is platinum(II) acetylacetonate and the transition metal precursor is cobalt(II) acetylacetonate, dicobalt octacarbonyl or nickel(II) acetylacetonate. The shape-controlled alloy particles have a uniform, truncated octahedral shape.

In another example of the method, the surfactant is potassium bromide, the solvent is benzyl alcohol, the noble metal precursor is platinum(II) acetylacetonate and the transition metal precursor is cobalt(II) acetylacetonate, dicobalt octacarbonyl or nickel(II) acetylacetonate. The shape-controlled alloy particles have a uniform, cubic shape.

Although the examples use platinum(II) acetylacetonate as the noble metal precursor, other noble metal precursors can be used to make the shape-controlled alloys.

The method can further comprise filtering the mixture and washing the mixture with ethanol and acetone prior to drying. Drying can be for a number of hours.

The method can further comprise controlling the size of the shape-controlled alloy particles in addition to the shape by adjusting the irradiation temperature and time, with the size increasing with higher temperature and longer irradiation, while remaining between 185° C. and 195° C. for thirty minutes or less. When heating lasts too long, precursors develop a nucleus which negatively affects the shape.

Figure 2:
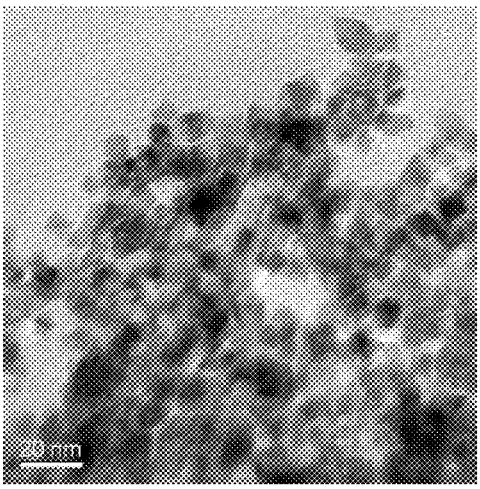
FIG. 2 is a transmission electron microscopy image of platinum-nickel alloy particles made with the method of FIG. 1.

FIG. 2 is a transmission electron microscopy image of platinum-nickel alloy particles made with the methods herein. The surfactant used was benzoic acid, the solvent was benzyl alcohol, the noble metal precursor was platinum (II) acetylacetonate and the transition metal precursor was nickel(II) acetylacetonate. The resulting platinum-nickel alloy has a uniform, octahedral shape, as seen in FIG. 2.

Figure 3:
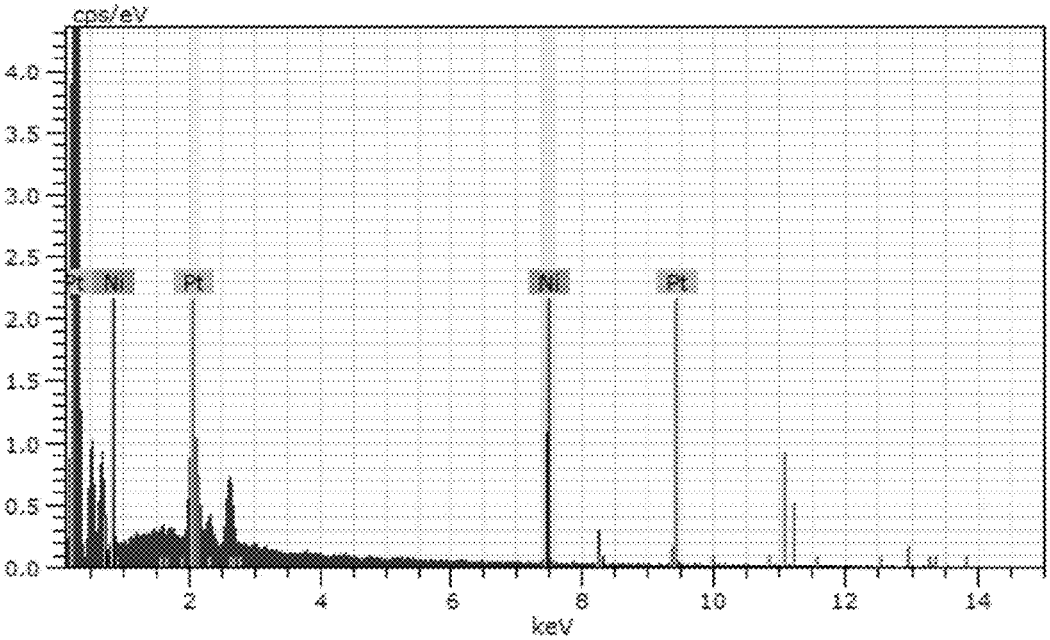
FIG. 3 shows results of scanning electron microscopy/energy dispersive X-ray spectroscopy of the platinum-nickel alloy shown in FIG. 2.

FIG. 3 shows results of scanning electron microscopy/energy dispersive X-ray spectroscopy of the platinum-nickel alloy shown in FIG. 2. The results of the spectroscopy confirms that composition of the platinum-nickel alloy.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A or B, X can include A alone, X can include B alone or X can include both A and B. In addition, the articles "a" and "an" as used in this application and the appended claims should generally be construed to mean "one or more" unless specified otherwise or clear from context to be directed to a singular form.

The above-described embodiments, implementations and aspects have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

Other embodiments or implementations may be within the scope of the following claims.

What is claimed is:

1. A method of preparing shape-controlled alloy particles comprising:

dissolving a solvent in a surfactant selected to inhibit particle growth;

adding a noble metal precursor and a transition metal precursor to form a mixture;

irradiating the mixture with a microwave under reflux for about thirty minutes or less at an irradiation temperature of between 185° C. and 195° C.;

cooling the mixture; and drying the mixture at a temperature of between 55° C. and 65° C. to obtain shape-controlled alloy particles having a uniform shape, the shape dependent upon the surfactant used.

2. The method of claim 1, wherein the surfactant is benzoic acid, the solvent is benzyl alcohol, the noble metal precursor is platinum(II) acetylacetonate and the transition metal precursor is nickel(II) acetylacetonate.

3. The method of claim 2 wherein the shape-controlled alloy particles have an octahedral shape.

4. The method of claim 1, wherein the solvent is 1,2-hexadecanediol, the surfactant is oleylamine, the noble metal precursor is platinum(II) acetylacetonate and the transition metal precursor is cobalt(II) acetylacetonate or dicobalt octacarbonyl.

5. The method of claim 4, wherein the shape-controlled alloy particles have an octahedral shape.

6. The method of claim 1, wherein the surfactant is aniline, the solvent is benzyl alcohol and the shape-controlled alloy particles have a truncated octahedral shape.

7. The method of claim 1, wherein the surfactant is potassium bromide, the solvent is benzyl alcohol and the shape-controlled alloy particles have a cubic shape.

8. The method of claim 1, further comprising:

filtering the mixture and washing the mixture with ethanol and acetone prior to drying.

9. A method of preparing shape-controlled platinum alloy particles comprising:

thoroughly dissolving benzyl alcohol in a surfactant selected to inhibit particle growth;

adding a platinum precursor and a nickel precursor to form a mixture;

irradiating the mixture with a microwave under reflux for about thirty minutes or less at an irradiation temperature of between 185° C. and 195° C.;

cooling the mixture; and drying the mixture at a temperature of between 55° C. and 65° C. to obtain shape-controlled platinum alloy particles.

10. The method of claim 9, further comprising:

filtering the mixture and washing the mixture with ethanol and acetone prior to drying.

11. The method of claim 9, wherein the surfactant is benzoic acid and the shapecontrolled alloy particles have an octahedral shape.

12. The method of claim 9, wherein the surfactant is aniline and the shapecontrolled alloy particles have a truncated octahedral shape.

13. The method of claim 1, wherein the surfactant is potassium bromide and the shape-controlled alloy particles have a cubic shape.

* * * * *